US007421842B2

(12) United States Patent
Parker et al.

(10) Patent No.: US 7,421,842 B2
(45) Date of Patent: Sep. 9, 2008

(54) TURBINE SPRING CLIP SEAL

(75) Inventors: David M. Parker, Oviedo, FL (US); Rajeev Ohri, Winter Springs, FL (US)

(73) Assignee: Siemens Power Generation, Inc., Orlando, FL (US)

( * ) Notice: Subject to any disclaimer, the term of this patent is extended or adjusted under 35 U.S.C. 154(b) by 418 days.

(21) Appl. No.: 11/183,692

(22) Filed: Jul. 18, 2005

(65) Prior Publication Data

US 2007/0012043 A1 Jan. 18, 2007

(51) Int. Cl.
*F02C 7/18* (2006.01)
*F16K 15/12* (2006.01)

(52) U.S. Cl. ..... 60/752; 60/39.83; 277/654; 415/180

(58) Field of Classification Search ..... 60/752, 60/39.83; 415/175, 180; 277/654
See application file for complete search history.

(56) References Cited

U.S. PATENT DOCUMENTS

| | | | | |
|---|---|---|---|---|
| 3,670,497 | A | 6/1972 | Sheldon | |
| 3,759,038 | A | 9/1973 | Scalzo et al. | |
| 4,413,470 | A | 11/1983 | Scheihing et al. | |
| 4,413,477 | A * | 11/1983 | Dean et al. | 60/757 |
| 4,527,397 | A | 7/1985 | Tobery et al. | |
| 4,645,217 | A * | 2/1987 | Honeycutt et al. | 277/555 |
| 4,688,378 | A | 8/1987 | Harris | |
| 5,143,292 | A * | 9/1992 | Corsmeier et al. | 239/127.3 |
| 5,239,831 | A * | 8/1993 | Kuroda et al. | 60/737 |
| 5,987,879 | A | 11/1999 | Ono | |
| 6,464,232 | B1 | 10/2002 | Marchi et al. | |
| 6,464,457 | B1 | 10/2002 | Morgan et al. | |
| 6,668,559 | B2 | 12/2003 | Calvez et al. | |
| 6,675,585 | B2 | 1/2004 | Calvez et al. | |
| 7,082,770 | B2 * | 8/2006 | Martling et al. | 60/752 |
| 7,096,668 | B2 * | 8/2006 | Martling et al. | 60/757 |
| 7,269,957 | B2 * | 9/2007 | Martling et al. | 60/800 |
| 2004/0251639 | A1 | 12/2004 | Parker | |
| 2005/0062237 | A1 * | 3/2005 | Parker et al. | 277/654 |
| 2005/0132708 | A1 | 6/2005 | Martling et al. | |

FOREIGN PATENT DOCUMENTS

| | | | |
|---|---|---|---|
| EP | 0136071 | A1 | 4/1985 |
| EP | 0875721 | A1 | 11/1998 |
| EP | 1403584 | A1 * | 3/2004 |
| JP | 58102031 | A1 | 6/1983 |

* cited by examiner

*Primary Examiner*—Ted Kim

(57) ABSTRACT

An improved turbine spring clip seal for directing gases to be mixed with fuel in a combustor basket. The turbine spring clip seal may include an inner housing and an outer housing. The inner housing or the outer housing, or both, may be shortened relative to conventional clips and may include a cooling channel proximate to a point of attachment to the combustor basket.

20 Claims, 4 Drawing Sheets

TURBINE SPRING CLIP SEAL

FIELD OF THE INVENTION

The present invention relates in general to sealing systems and, more particularly, to an improved turbine spring clip seal for directing gases to mix with fuel in a combustor basket in a turbine engine.

BACKGROUND OF THE INVENTION

There exists a plethora of variables that affect performance of a turbine engine. One such variable that has been identified in dry-low NOx (DLN) combustor design turbines is the air flow distribution between the combustor zone and the leakage air flows. Typically, a spring clip seal is used in such a turbine engine to direct gases, such as common air, into a combustor basket where the air mixes with fuel. Conventional spring clip seals direct air through center apertures in the seals and are formed from outer and inner housings. The seals are generally cylindrical cones that taper from a first diameter to a second, smaller diameter. The first diameter is often placed in contact with a transition inlet ring, and the second, smaller diameter is often fixedly attached to a combustor basket. The inner and outer housings include a plurality of slots around the perimeter of the housings which form leaves in the housing. In at least one conventional embodiment, twenty slots are positioned generally equidistant to each other at the perimeter of the housing. The leaves are capable of flexing and thereby imparting spring properties to the spring clip seal. This spring force assists in at least partially sealing the inner housing to the outer housing.

Conventional spring clips allow up to 8% of the total air flow distribution flowing through a center aperture of a spring clip seal to leak through the seal. Such leakage can often cause undesirable outcomes. For instance, air leakage at this level can cause high engine performance variability, which is characterized by high NOx emissions, high dynamics or flashback, or any combination thereof.

Turbine spring clip seals have attempted to reduce leakage across the seal by configuring the inner housing and the outer housing, each having a plurality of slots, so that the slots in the inner housing are offset relative to the slots in an outer housing, thereby reducing leakage across the seal. However, the number of slots contained in conventional seals limits the ability of the seals to prevent air leakage.

Therefore, there exists a need for an improved turbine spring clip seal.

SUMMARY OF THE INVENTION

Set forth below is a brief summary of the invention that solves the foregoing problems and provides benefits and advantages in accordance with the purposes of the present invention as embodied and broadly described herein. This invention is directed to a turbine spring clip seal having reduced stresses and loads during operation and use for sealing openings between adjacent turbine components and directing air through a center aperture in the seal. The turbine spring clip seal of the invention is generally composed of an outer housing and an inner housing. The outer and inner housings each includes a coupler section and a transition section. The coupler section of the outer housing is configured to be fixedly attached to a first turbine component, and the transition section of the outer housing extends from the coupler section at a first end of the transition section. The transition section is also adapted to maintain contact between a second end of the transition section and a second turbine component during operation of a turbine. The transition section tapers from a first diameter at the first end of the transition section at the coupler sections to a second diameter, which is larger than the first diameter, at the second end of the transition section.

The inner housing also has a coupler section and a transition section that may be shaped similarly to the outer housing and sized to nest within the outer housing. The inner coupler section of the inner housing is adapted to be fixedly attached to the outer coupler section of the outer housing. The inner transition extends from the inner coupler section at a first end of the inner transition section. The inner transition section continues to a second end of the transition section and secures to the outer housing during operation of the turbine. The inner housing is configured to fit inside the outer housing and, in one embodiment, tapers from a third diameter at the first end of the transition section at the coupler section to a fourth diameter, which is larger than the third diameter, at the second end of the inner transition section.

According to the invention, the inner or outer housing, or both, may be formed from two or more leaves defined by slots separating the leaves. The slots enable the leaves to flex during engine operation. The slots of the inner transition section may be offset circumferentially from the slots of the outer transition section. During movement of the leaves, contact with a turbine component is also facilitated by radially inwardly curved outer edges on the outer and inner transition sections.

The inner or outer housings, or both may include attachment flanges configured to facilitate attachment of the housings to a turbine component, such as a combustor basket. When viewed in cross-section, the attachment flange may be positioned generally parallel and offset relative to the body of the coupler sections. The attachment flange may have a smaller diameter than the body of the coupler section. This position enables formation of the cooling channel between the combustor basket and the spring clip seals proximate to the edge of the combustor basket. The cooling channel enables cooling fluids to be sent to the leading edge of the seal, which is an area subject to exposure to hot temperature gases in the combustor basket. The attachment flange may be attached to the remainder of the coupler section with an extension section.

The outer housing may include a thermal boundary coating to prevent premature failure of the spring clip seal. The thermal boundary coating may be applied to an outer surface of the outer housing, and more specifically, to the outer transition and coupler sections.

The inner and outer housings may be positioned at an angle between the first turbine component and the first transition section that is between about five and about twenty five degrees. Positioning the inner and outer housings in this manner enables the leading edge of the inner and outer housings to be offset from the edge of the combustor basket, thereby protecting the spring clip seal from exposure to the hot temperatures located in the combustor gas stream located at the edge of the combustor basket. The spring clip seal may also be formed from materials that are more flexible than conventional materials, thereby enabling the angles previously identified without sacrificing flexibility of the spring clip seal.

An advantage of this invention is that the turbine spring clip seal reduces leakage, and may stop leakage, between an inner housing and an outer housing of the spring clip seal.

Another advantage of this invention is that this turbine spring clip seal experiences reduced levels of stress and load during operation of a turbine engine in which the turbine spring clip seal may be mounted. Formation of the cooling channel, use of more flexible materials, and the reduced overall length causing the change in the angle between the combustor basket and the spring clip seal all contribute to the reduced stress in the spring clip seal and improved efficiency and lifespan.

These and other advantages and objects will become apparent upon review of the detailed description of the invention set forth below.

BRIEF DESCRIPTION OF THE DRAWINGS

The accompanying drawings, which are incorporated in and form a part of the specification, illustrate embodiments of the presently disclosed invention and, together with the description, disclose the principles of the invention.

DETAILED DESCRIPTION OF THE INVENTION

Figure 1:
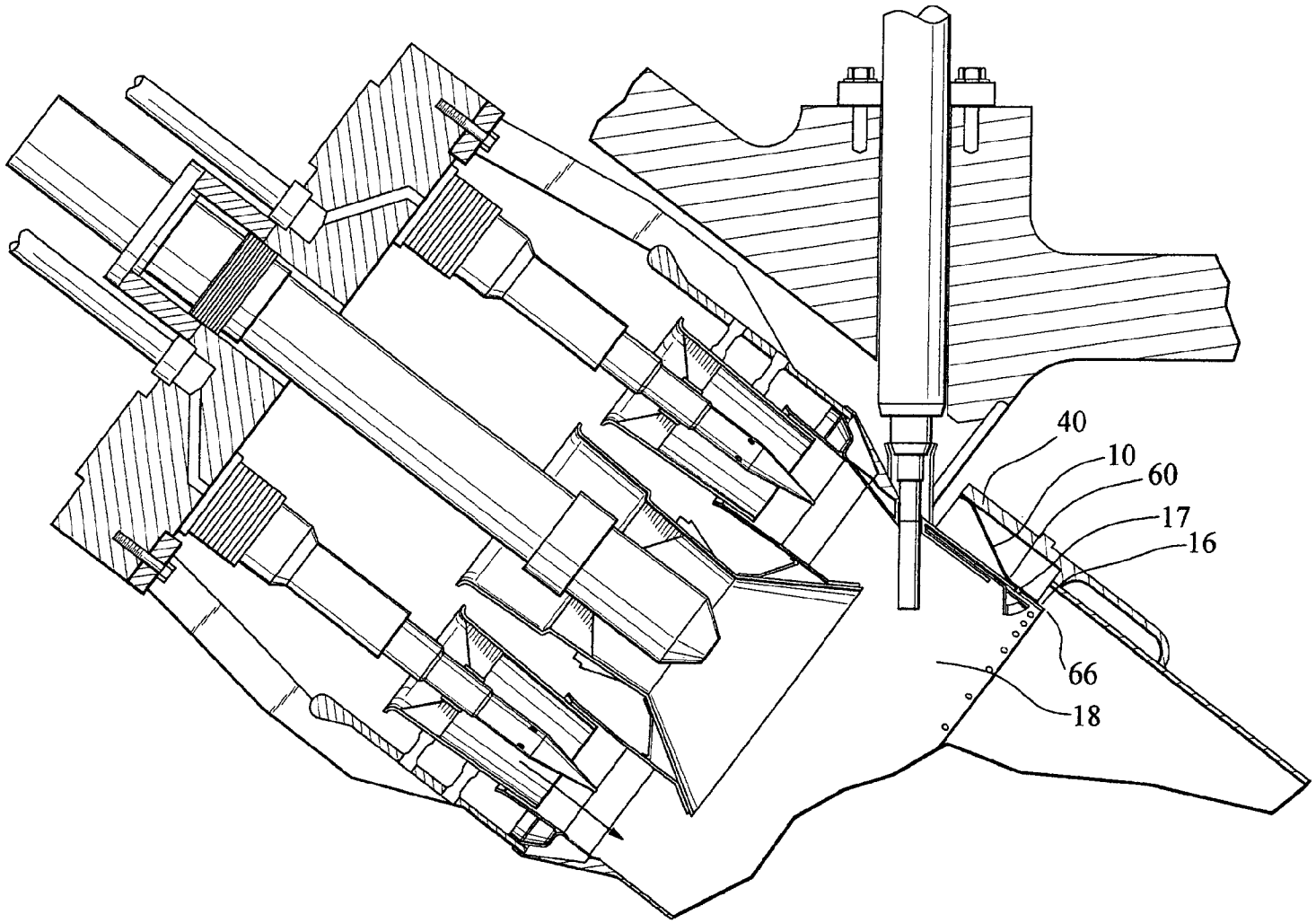
FIG. 1 is cross-sectional view of a turbine engine combustor subsystem showing a turbine spring clip seal forming a connection between a combustor basket and a combustion chamber.

As shown in FIGS. 1-5, this invention is directed to a turbine spring clip seal 10 that can be configured as a generally cylindrical- or ring-shaped assembly, including an outer housing 12 and an inner housing 14. The turbine spring clip seal 10 is usable in turbine engines to direct gases to mix with fuel flowing into a conventional combustor basket 16. The spring clip seal 10 is intended to direct fluid flow and to prevent air directed through the center aperture 18 in the turbine spring seal 10 from leaking between the outer and inner housings 12 and 14. The flow region within the center aperture 18 is relatively lower in pressure than the region 13 outside of housing 12, so that fluid leakage generally occurs from the outside in.

Figure 2:
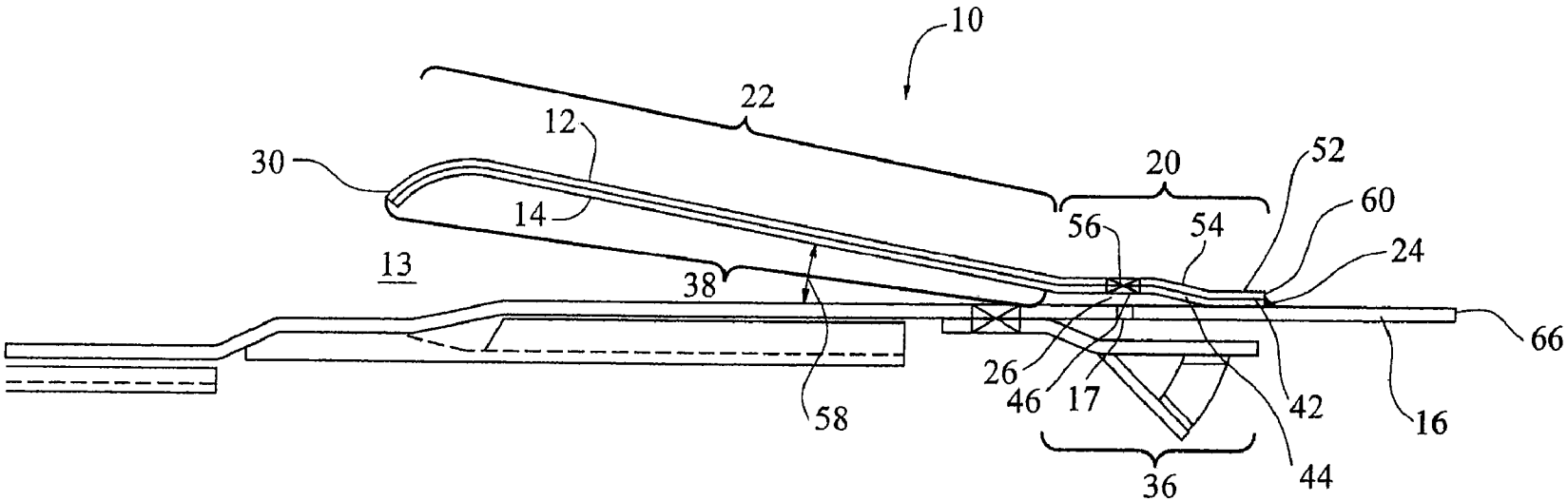
FIG. 2 is a cross-sectional side view of the turbine spring clip seal shown in FIG. 1.
Figure 3:
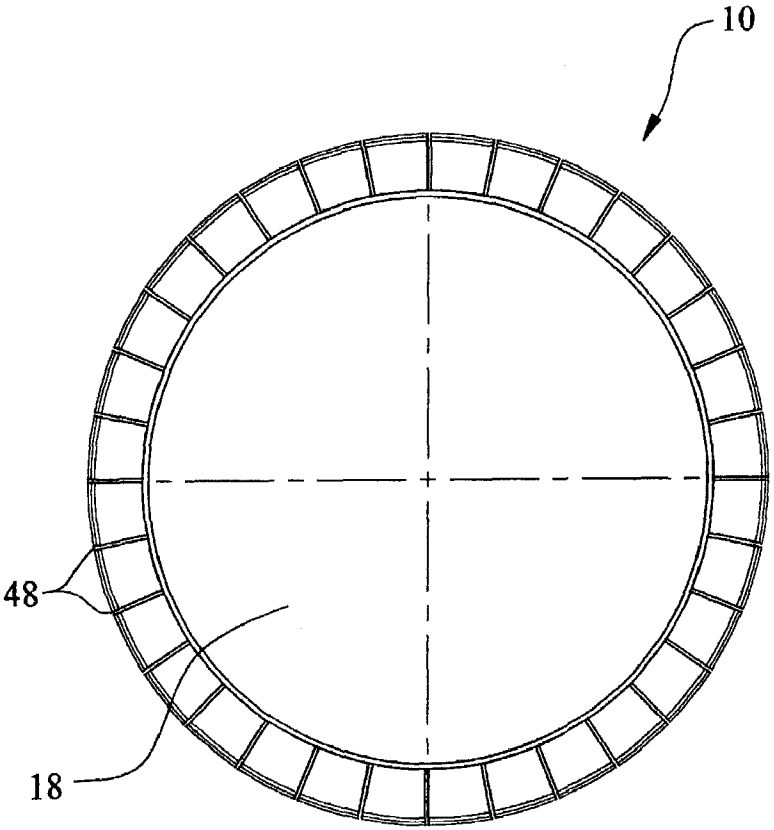
FIG. 3 is a front plan view of a turbine spring clip seal of the invention composed of an outer housing and an inner housing viewed so that the inner housing is visible.
Figure 5:
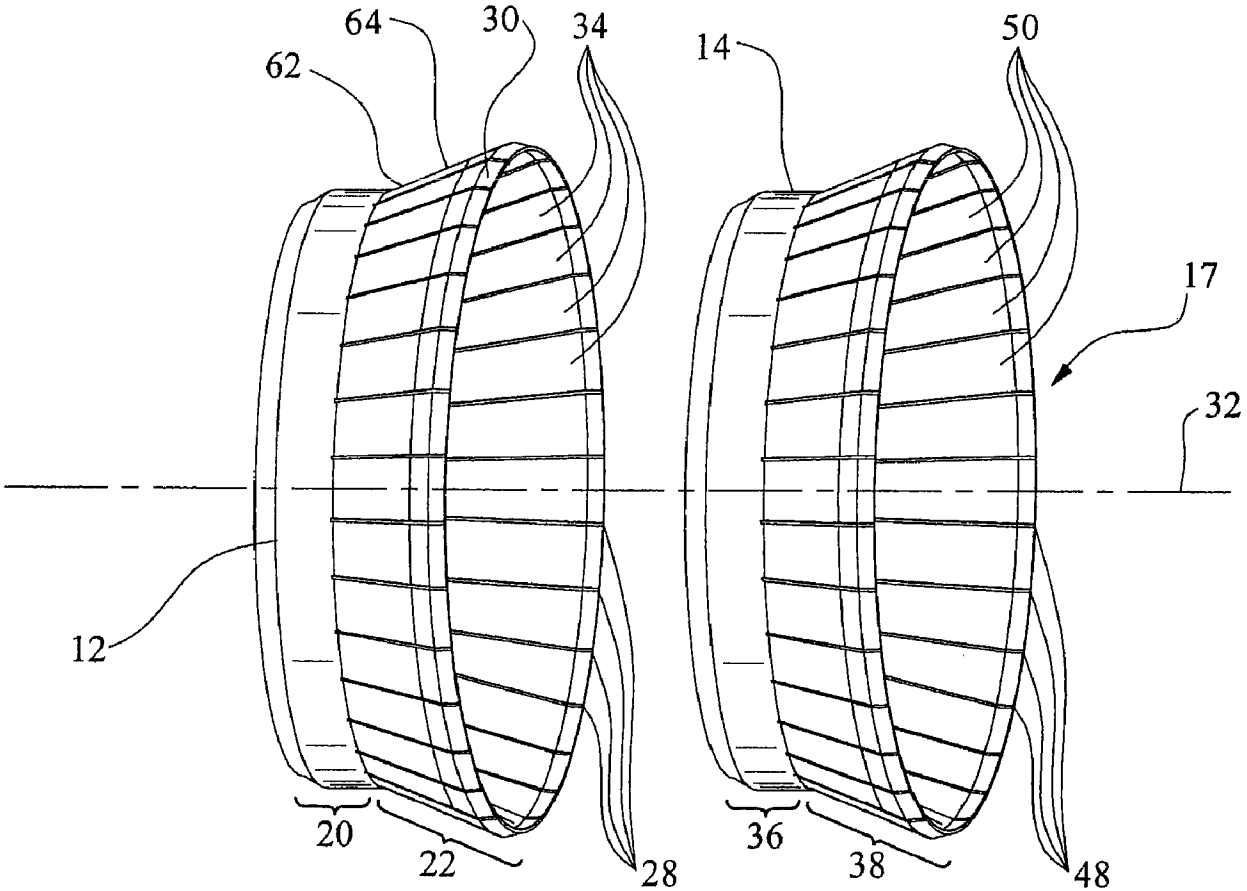
FIG. 5 is an exploded view of the turbine spring clip of the invention.

As shown in FIGS. 2, 3, and 5, the turbine spring clip seal 10 may be formed from the outer housing 12 and the inner housing 14. The inner housing 14 may be configured to nest in outer housing 12, as shown in FIGS. 3 and 5. The outer housing 12, as shown in FIGS. 2 and 5, may be formed from an outer coupler section 20 and an outer transition section 22 extending therefrom. In one embodiment, the outer housing 12 may have a configuration resembling a conventional reducer and have a generally conical shape, although alternative geometries are considered within the scope of the invention. The outer coupler section 20 may be in the shape of a ring and may be configured to be fixedly attached to a turbine component using for instance, a weld bond 24. In at least one embodiment, the outer coupler section 20 may be fixedly attached to a combustor basket 16 with a continuous weld bond 24, as shown in FIG. 2. The continuous weld bond 24 seals the spring clip seal 10 to the turbine component enabling formation of a cooling channel 26. In one embodiment, the outer transition section 22 has a general conical shape.

The outer housing 12 also may include a plurality of slots 28 that are typically located in the outer transition section 22. The slots 28 preferably extend from an edge 30 of the outer transition section 22 into the outer transition section 22 toward the outer coupler section 20. As shown in FIG. 2, the outer edge 30 may have be radially inwardly curved enabling smooth movement of the portion contacting the surface 40. The slots 28 may have any length, and in one embodiment, one or more of the slots 28 may extend to the outer coupler section 20. In yet another embodiment, the slots 28 may extend through the width of the outer transition section 22 and into the coupler section 20. However, the slots 28 should not extend completely through the coupler section 20.

The plurality of slots 28 may be composed of two or more slots. The slots 28 are positioned generally parallel to a longitudinal axis 32 of the turbine spring clip seal 10 and the outer housing 12 and form leaves 34 between adjacent slots 24. The leaves 34 are flexible and are capable of deflecting radially inwardly. The number of slots 24 may be increased relative to conventional designs to reduce the bending stress in the seal 10. For instance, in at least one embodiment, the number of slots may be between about twenty one slots and about twenty six slots.

The outer coupler section 20 may be formed from an outer attachment flange 52 configured to be attached to a turbine component, such as a combustor basket 16. The outer attachment flange 52 may have a diameter that is less than a diameter of the remainder of the outer coupler section 20. An outer extension section 54 may couple the outer attachment flange 52 to the body 56 of the outer coupler section 20 forming the remainder of the outer coupler section 20. The outer attachment flange 52 may be configured to form the cooling channel 26.

The turbine spring clip seal 10 may include an inner housing 14 formed from an inner coupler section 36 attached to an inner transition section 38. The inner coupler and transition sections 36, 38 may have cross-sectional shapes that are substantially similar to those of the outer housing 12, enabling the inner housing 14 to nest inside the outer housing 12, as shown in FIG. 2. The inner coupler section 36 may be formed from an inner attachment flange 42 configured to be attached to a turbine component, such as a combustor basket 16. The inner attachment flange 42 may have a diameter that is less than a diameter of the remainder of the inner coupler section 36. An inner extension section 44 may couple the inner attachment flange 42 to the body 46 of the inner coupler section 36 forming the remainder of the inner coupler section 36.

The inner attachment flange 42 may be configured to form the cooling channel 26. The cooling channel 26 may pass cooling fluids along the combustor basket 16 to prevent premature failure of the spring clip seal 10. The cooling channel 26 may be positioned in fluid communication with orifices 17 in the combustor basket 16. The orifices 17 facilitate cooling fluid flow through the cooling channel 26 and be exhausted from the cooling channel 26 into the gases in the combustor basket 16. The orifices 17 may be positioned circumferentially around the combustor basket 16 and proximate to the edge 66.

Figure 4:
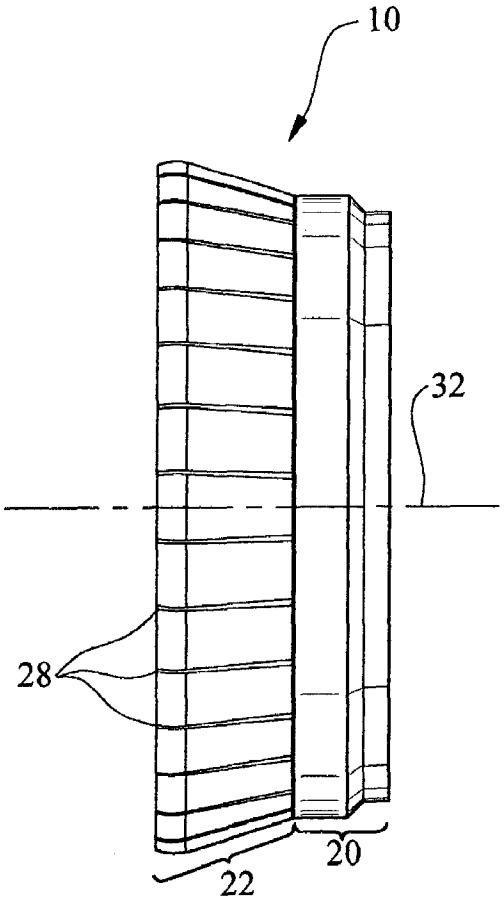
FIG. 4 is a side view of the turbine spring clip seal of the invention.

The inner housing 14 may include a plurality of slots 48 that form leaves 50 in the inner transition section 38. The leaves 50 enable the inner housing 14 to flex under operating conditions, such as vibrations and thermal expansion. In at least one embodiment, the leaves 50 of the inner housing 14 may be offset circumferentially, as shown in FIGS. 3 and 4, from the leaves 34 in the outer housing 12.

The inner and outer transition sections 38, 22 may be positioned at an angle 58 between about five degrees and about twenty five degrees relative to the combustor basket 16. Such an angle is possible in at least one embodiment by having a length of the transition sections 22, 38 of between about three inches and about six inches. Such a position enables the leading edge 60 to be offset axially relative to the edge 66 of the combustor basket 16. Offsetting the leading edge 60 from the edge 66 of the combustor basket 16 reduces the temperature of the spring clip seal 10 because the temperature at the edge 66 of the combustor basket 16 is greater than at areas removed from the edge 66. Such a position increases the life of the spring clip seal 10.

The spring slip seal 10 may be formed from any high strength and high temperature material such as, but not limited to, X750 or other suitable nickel based or other materials. The inner and outer housings 14 and 12 may each have a thickness of about 0.050 of an inch. In addition, the material may have a tensile strength about between about 140 ksi and about 180 ksi enabling the inner and outer transition sections 38, 22 of the seal 10 to have enough flexibility to accommodate the vibrations encountered during turbine engine operation.

An outside diameter of the outer housing 12 of the spring clip seal 10 may be reduced between about 1 millimeter and about 5 millimeters relative to conventional configurations to reduce the amount of preloaded spring compression. In at least one embodiment, an outside diameter of the outer housing 12 of the spring clip seal 10 may be reduced about 3.5 millimeters relative to conventional configurations. Such a reduction in diameter may result in a reduction of preloaded spring compression of about thirty percent.

The spring clip seal 10 may also include a temperature reducing device for shielding the seal 10 from the combustor gases. In at least one embodiment, the seal 10 may include a thermal barrier coating 62 positioned on an outer surface 64 of the outer housing 12, such as on the outer transition section 22 and the outer coupler section 22. The thermal barrier coating 62 may be formed from any appropriate material, and the thickness of the coatings may be varied.

The foregoing is provided for purposes of illustrating, explaining, and describing embodiments of this invention. Modifications and adaptations to these embodiments will be apparent to those skilled in the art and may be made without departing from the scope or spirit of this invention or the following claims.

We claim:

1. A turbine seal, comprising:

a combustor basket;

an inner housing having an inner coupler section adapted to be attached to the combustor basket and an inner transition section extending from the inner coupler section at a first end of the inner transition section and continuing to a second end of the inner transition section, the second end being adapted to be attached to a second turbine component, wherein the inner transition section tapers from a second diameter at the second end to a first diameter, which is smaller than the second diameter, at the first end;

wherein the inner transition section is formed from a plurality of leaves extending from the inner coupler section to the second end of the inner transition section, and each leaf is separated by a slot; and wherein the inner coupler section includes an inner attachment flange transitioning to a body, the inner attachment flange being generally cylindrical and having a diameter, the body being generally cylindrical and having a diameter, wherein the diameter of the inner attachment flange is less than the diameter of the body, the inner transition section being angled relative to the generally cylindrical body, the inner coupler section engaging the combustor basket such that attachment flange directly contacts the combustor basket and such that the body surrounds and is radially spaced from a portion of the combustor basket such that a cooling fluid flow channel is formed between the body of the inner coupler section and the combustor basket.

2. The turbine seal of claim 1, wherein the inner attachment flange is generally parallel and offset relative to the body of the inner coupler section.

3. The turbine seal of claim 1, further comprising an inner extension member extending between the outer attachment flange and the body of the inner coupler section.

4. The turbine seal of claim 1, wherein the inner transition section includes a radially inwardly curved outer edge.

5. The turbine seal of claim 1, further comprising an outer housing having an outer coupler section attached to an outer surface of the inner coupler section and an outer transition section extending from the outer coupler section at a first end of the outer transition section and continuing to a second end of the outer transition section and attached to an outer surface of the inner transition section, wherein the outer transition section tapers from a second diameter at the second end to a first diameter, which is smaller than the second diameter, at the first end;

wherein the outer transition section is formed from a plurality of leaves extending from the outer coupler section to the second end of the outer transition section, and each leaf is separated by a slot; and wherein the outer coupler section includes an outer attachment flange transitioning to a body, the outer attachment flange being generall ycylindrical and having a diameter, the body being generally cylindrical and having a diameter, wherein the diameter of the outer attachment flange is less than the diameter of the body of the outer coupler section.

6. The turbine seal of claim 5, wherein the slots in the inner transition section are offset circumferentially from the slots in the outer transition section.

7. The turbine seal of claim 1, further comprising a thermal boundary layer on an outer surface of the outer transition section.

8. The turbine seal of claim 7, further comprising a thermal boundary layer on an outer surface of the outer coupler section.

9. The turbine seal of claim 1, wherein an angle between the combustor basket and the inner transition section is between about five degrees and about twenty five degrees.

10. A turbine seal, comprising:

an outer housing having an outer coupler section and an outer transition section extending from the outer coupler section at a first end of the outer transition section and continuing to a second end of the outer transition section, adapted to be attached to a second turbine component, wherein the outer transition section tapers from a second diameter at the second end to a first diameter, which is smaller than the second diameter, at the first end;

wherein the outer transition section is formed from a plurality of leaves extending from the outer coupler section to the second end of the outer transition section, and each leaf is separated by a slot; and wherein the outer coupler section includes an outer attachment flange transitioning to a body, the outer attachment flange being generally cylindrical and having a diameter, the body being generally cylindrical and having a diameter, wherein the diameter of the outer attachment flange is less than the diameter of the body of the outer coupler section, the outer transition section being angled relative to the generally cylindrical body;

an inner housing having an inner coupler section attached to an inner surface of the outer coupler section and an inner transition section extending from the inner coupler section at a first end of the inner transition section and continuing to a second end of the inner transition section, the inner transition section is attached to an inner surface of the outer transition section, wherein the inner transition section tapers from a second diameter at the second end to a first diameter, which is smaller than the second diameter, at the first end;

wherein the inner transition section is formed from a plurality of leaves extending from the inner coupler section to the second end of the inner transition section, and each leaf is separated by a slot; and wherein the inner coupler section includes an inner attachment flange transitioning to a body, the inner attachment flange being generally cylindrical and having a diameter, the body being generally cylindrical and having a diameter, wherein the diameter of the inner attachment flange is less than the diameter of the body of the inner coupler section, the inner transition section being angled relative to the generally cylindrical body, the inner coupler section engaging a first turbine component such that attachment flange directly contacts the first turbine component and such that the body surrounds and is radially spaced from a portion of the first turbine component such that a cooling fluid flow channel is formed between the body of the inner coupler section and the first turbine component.

11. The turbine seal of claim 10, wherein the inner and outer attachment flanges are generally parallel and offset relative to the body of the outer coupler section.

12. The turbine seal of claim 10, further comprising an inner extension member extending between the inner attachment flange and the body of the inner coupler section.

13. The turbine seal of claim 10, wherein the outer transition section includes a radially inwardly curved outer edge and the inner transition section includes a radially inwardly curved outer edge that mates with the outer transition section.

14. The turbine seal of claim 10, wherein the slots in the inner transition section are offset circumferentially from the slots in the outer transition section.

15. The turbine seal of claim 10, further comprising a thermal boundary layer on an outer surface of the outer transition section.

16. The turbine seal of claim 10, further comprising a thermal boundary layer on an outer surface of the outer coupler section.

17. The turbine seal of claim 10, wherein the first turbine component is a combustor basket.

18. The turbine seal of claim 17, wherein the combustor basket has at least one orifice proximate to an outer edge of the basket and in communication with the cooling fluid flow channel, wherein the orifice extends substantially radially through the combustor basket.

19. The turbine seal of claim 18, wherein an angle between the first turbine component and the first transition section is between about five degrees and about twenty five degrees.

20. The turbine seal of claim 18, wherein the orifice is located in the portion of the combustor basket that is surrounded by the body of the inner coupler section.

* * * * *